US007061358B1

(12) United States Patent
Yang

(10) Patent No.: US 7,061,358 B1
(45) Date of Patent: Jun. 13, 2006

(54) STRUCTURE OF INDUCTANCE CORE AND WIRE FRAME

(76) Inventor: Sen-Tai Yang, 192, Lung-En St., San Hsia Town, Taipei Hsien (TW)

( * ) Notice: Subject to any disclaimer, the term of this patent is extended or adjusted under 35 U.S.C. 154(b) by 0 days.

(21) Appl. No.: 11/224,483

(22) Filed: Sep. 12, 2005

(51) Int. Cl.
*H01F 27/30* (2006.01)

(52) U.S. Cl. ..... 336/198

(58) Field of Classification Search ..... 336/65, 336/83, 192, 198, 220–223
See application file for complete search history.

(56) References Cited

U.S. PATENT DOCUMENTS 4,549,158 A * 10/1985 Mitsui et al. ..... 336/83
5,359,313 A * 10/1994 Watanabe et al. ..... 336/178
6,714,111 B1 * 3/2004 Suzuki ..... 336/110

* cited by examiner

*Primary Examiner*—Tuyen T Nguyen

(74) *Attorney, Agent, or Firm*—Alan D. Kamrath; Nikolai & Mersereau, P.A.

(57) ABSTRACT

An improved structure of inductance core and wire frame mainly provides a center post at the center portion of the core. A containing circumferential channel is also provided at the periphery of the center post to make the outer circumference of the containing circumferential channel form a surrounded circumferential side wall that has small area of indentation openings at the end corners only. A center hole is also provided at the center portion of the wire frame that accommodates the center post, and a bobbin for the winding of the coil is further provided at the outer circumference of the center hole. A salient lead-out seat is provided at the end corner of the wire frame, and brazing posts are also provided on the same side at the upper edge of each of the lead-out seat to connect to the drawing head of the coil. By the use of the center post of the core embedding into the center hole of the wire frame, as well as making use of the containing circumferential channel to contain the wire frame, each of the lead-out seat of the wire frame can stretch out through the openings of the core. The magnetic leakage can be lessened and the inductance efficiency can be improved by making use of the circumferential side wall to form an integral surrounded covering.

2 Claims, 5 Drawing Sheets

STRUCTURE OF INDUCTANCE CORE AND WIRE FRAME

BACKGROUND OF THE INVENTION

1. Field of the Invention

The invention relates to an improved structure of inductance core and wire frame, and more particularly, to a core structure that can effectively increase the covering area of the core with respect to the coil, lessen the inductance leakage and improve the efficiency of inductance device.

2. Description of the Prior Art

As shown in FIG. 1, the core (5) of a conventional core structure of the inductance or the transformer appears mainly in E-shape. The core (5) includes a center post (51) and two side posts (53) that are salient in the same direction and disposed at the center and at the ends thereof respectively, as well as recessed portions (52) positioned between the center post (51) and the side posts (53). A wire frame (6), being accommodating the core (5) for assembling into an inductance or a transformer, has a center hole (61) at the center portion thereof. The center hole (61) has a bobbin (62) at the periphery thereof for the winding of a coil (621). Brazing posts (63) having drawing heads (not shown in the Figure) for pulling out the wire (not shown in the Figure) from the coil (621) make the center posts (51) of the two cores (5) insert into the center hole (61) of the wire frame (6). The center posts (51) then contact each other at their ends, and have their recessed portions (52) containing respectively the coils (621) at the periphery of the center hole (61). In the meantime, each of the side posts (53) of the two cores (5) forms a magnetic loop on the inner side of the coil (621) accommodating the center posts (51) at the two outer sides of the coil (621). However, since the covering area of the side posts (53) of the core (5) of the above-mentioned inductance or transformer is rather small, a large portion of the coil (621) of these kinds of structure exposes to the air. This will result in serious inductance leakage of the inductance or the transformer and will hardly improve the magnetic-induction efficiency.

Shown in FIG. 2 and FIG. 3 are relatively progressive structures of the prior art. A center hole (41) having a bobbin (42) at the periphery thereof for the winding of a coil (421) is provided at the center of the wire frame (4) of the structure. Moreover, extended portions (431) are also provided at both ends of the wire frame (4) to connect to the center section of two bus panels (432) having brazing posts (43) of the drawing head (not shown in the Figure) of lead-out coil (421). What is more, a center post (31) provided at the center of the core (3) has a containing channel (32) with side recesses (331) on the two opposite sides thereof. This makes the periphery of the containing channel (32) form two opposite side walls (33). When it comes to assembling, the two cores (3), after the center posts (31) inserting into the center hole (41), contact each other, and the containing channel (32) contains the bobbin (42) of the coil (421). In the meantime, the two extended portions (431) extend out through the side recesses (331) such that the bus panels (432) and the brazing posts (43) maintain at the location outside the core (3). A magnetic loop can be formed at the periphery of the bobbin (421) by the use of the side walls (33) accommodating the center posts (31). However, although this kind of inductance or transformer structure has a relatively large area of core covering as comparing with the above-mentioned prior art, there are still large areas of side recesses (331) that make the coil (421) expose to the air.

Therefore, there are still some rooms for improving the magnetic leakage and efficiency for the inductance or the transformer.

SUMMARY OF THE INVENTION

In light of the above-mentioned disadvantages of the prior arts, the invention provides an improved structure of inductance core and wire frame that can effectively increase the covering area of the core with respect to the coil, lessen the inductance leakage and improve the efficiency of inductance device. It aims to ameliorate at least some of the disadvantages of the prior art or to provide a useful alternative. The objective of the invention is to provide a center post at the center portion of the core. A containing circumferential channel is also provided at the periphery of the center post to make the outer circumference of the containing circumferential channel form a surrounded circumferential side wall that has small area of indentation openings at the end corners only. A center hole is also provided at the center portion of the wire frame that accommodates the center post, and a bobbin for the winding of the coil is further provided at the outer circumference of the center hole. A salient lead-out seat is provided at the end corner of the wire frame, and brazing posts are also provided on the same side at the upper edge of each of the lead-out seat to connect to the drawing head of the coil. By the use of the center post of the core embedding into the center hole of the wire frame, as well as making use of the containing circumferential channel to contain the wire frame, each of the lead-out seat of the wire frame can stretch out through the openings of the core. The magnetic leakage can be lessened and the inductance efficiency can be improved by making use of the circumferential side wall to form an integral surrounded covering. The accomplishment of this and other objectives of the invention will become apparent from the following description and its accompanying drawings of which:

DETAILED DESCRIPTION OF THE PREFERRED EMBODIMENT

Figure 1:
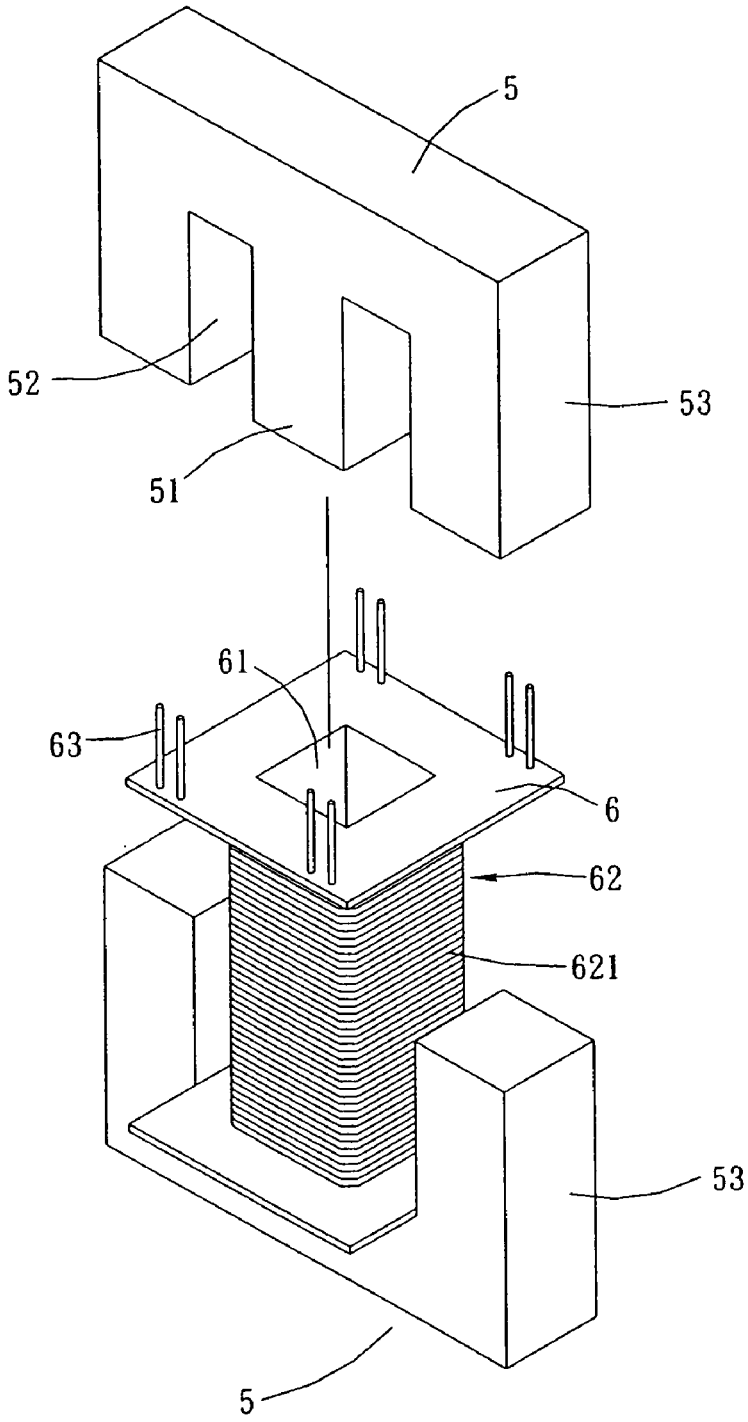
Fig.1 (Prior Art)
FIG. 1 is an exploded and isometric view of the inductance core and its relevant element structure of the prior art.
Figure 2:
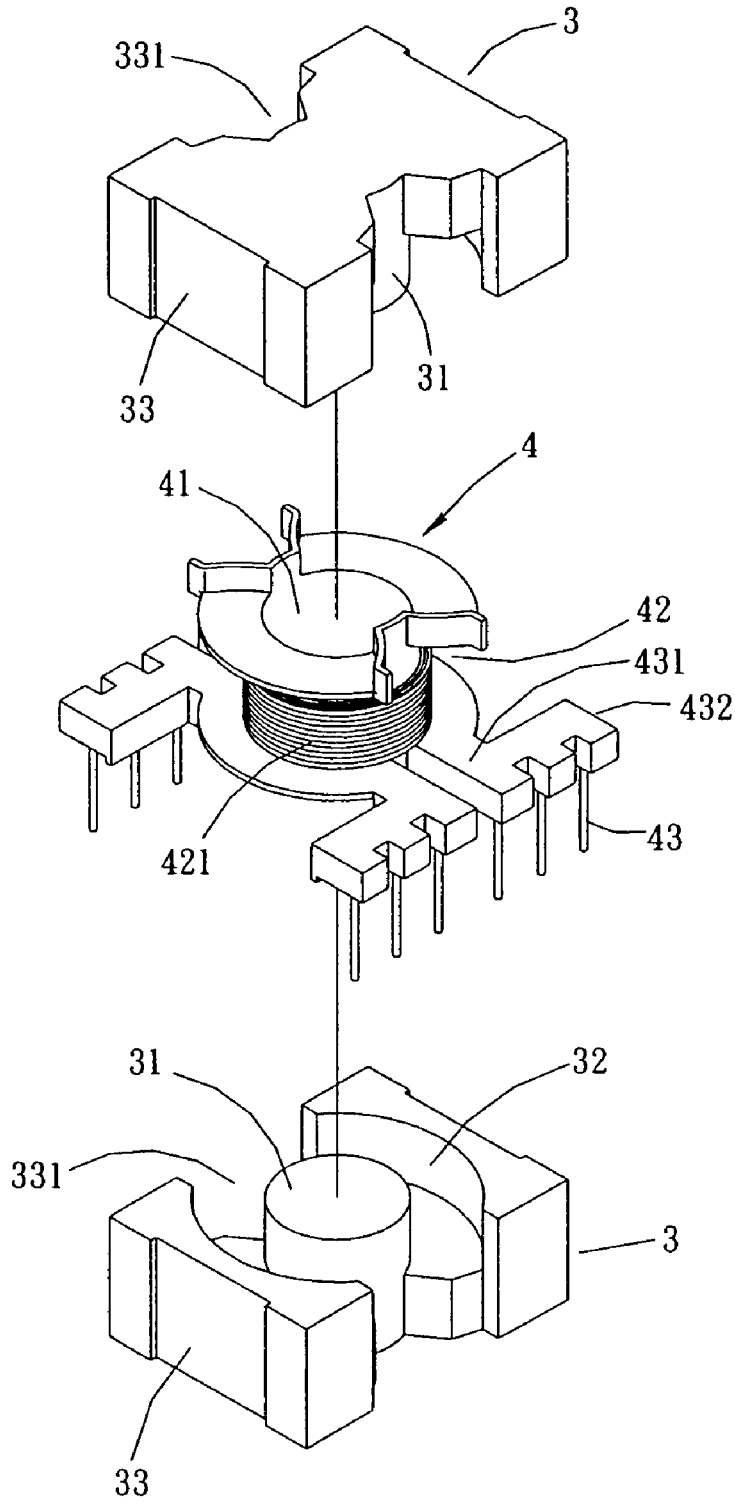
FIG. 2 is an exploded and isometric view of the inductance core and its relevant element structure of another prior art.
Figure 3:
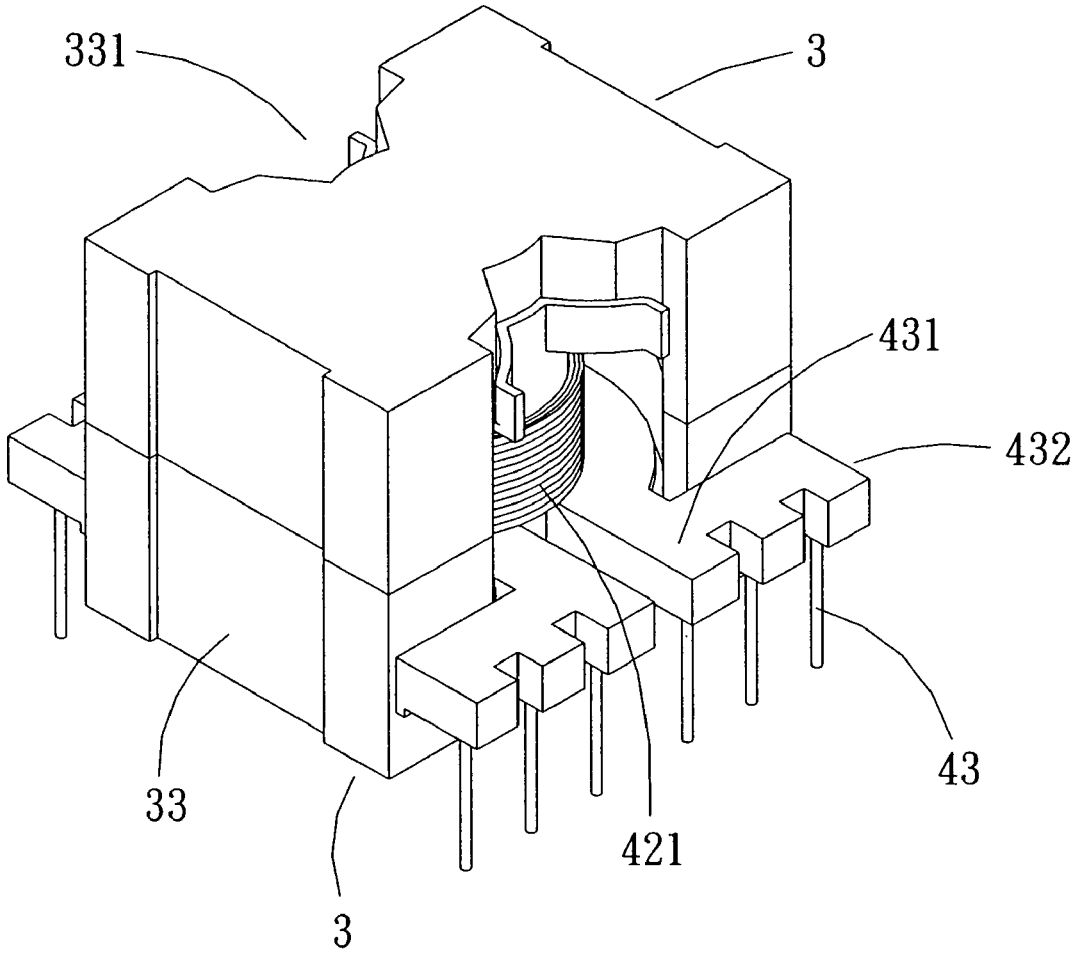
FIG. 3 is an exploded and isometric view of the inductance core and its relevant element structure of a further prior art.
Figure 4:
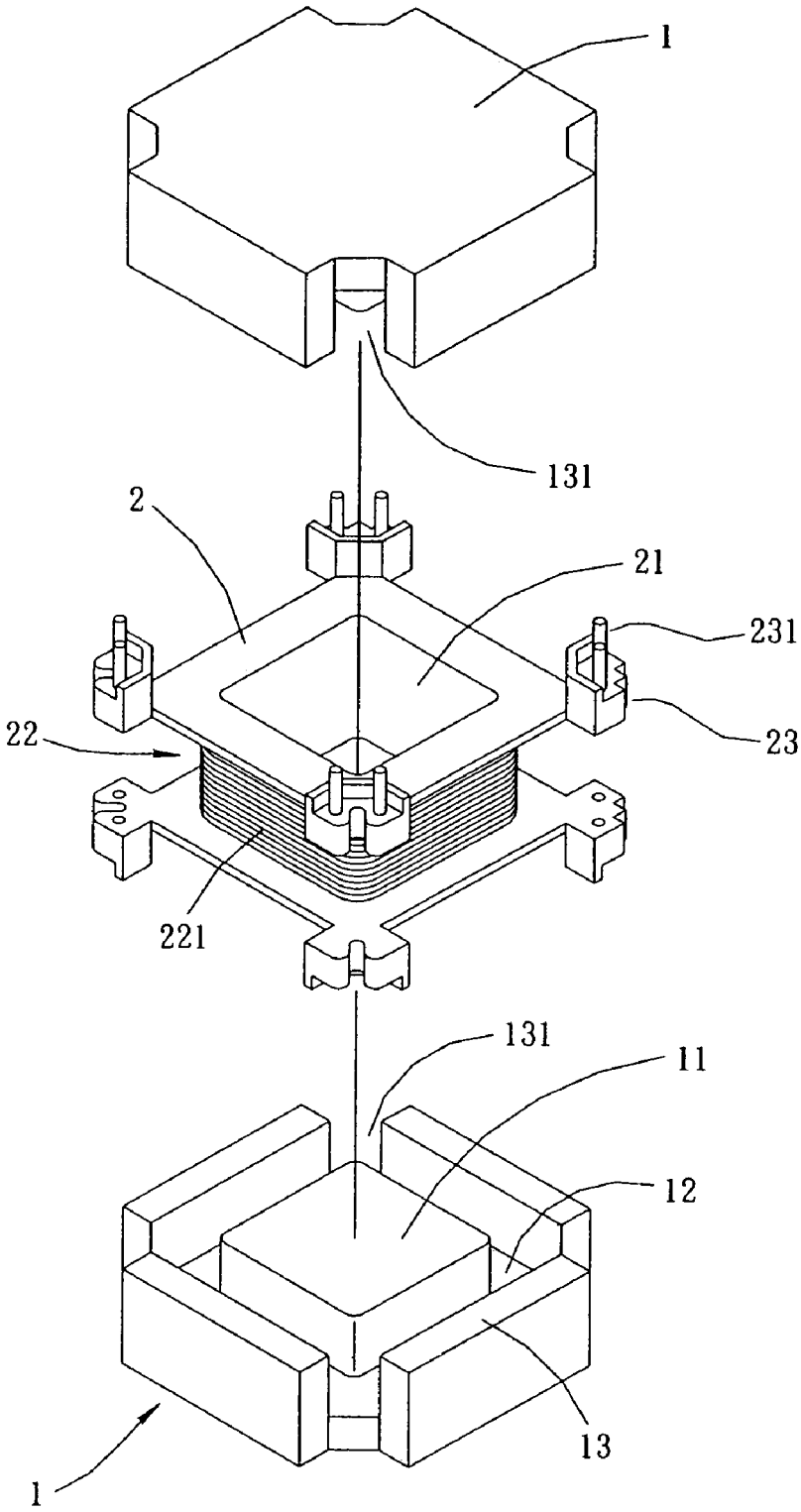
FIG. 4 is an exploded and isometric view of the inductance core and its relevant element structure of the invention.

FIG. 4 is an exploded and isometric view of the inductance core and its relevant element structure of the invention. As shown in FIG. 4, the invention mainly includes two portions: a core (1) and a wire frame (2). A center post (11) equipping at the center portion of the core (1) has a containing circumferential channel (12) providing at the periphery thereof and forming naturally a surrounded circumferential side wall (13) having small area of openings (131) at the corners. Moreover, a center hole (21) providing at the center portion of the wire frame (2) has a bobbin (22) providing at the periphery thereof for the winding of a coil (221). What is more, a salient lead-out seat (23) providing at the corners of the wire frame (2) has a brazing post (231) extending on the same side at each of the lead-out seat (23) and connecting respectively to the drawing head drawn from a coil (221).

Figure 5:
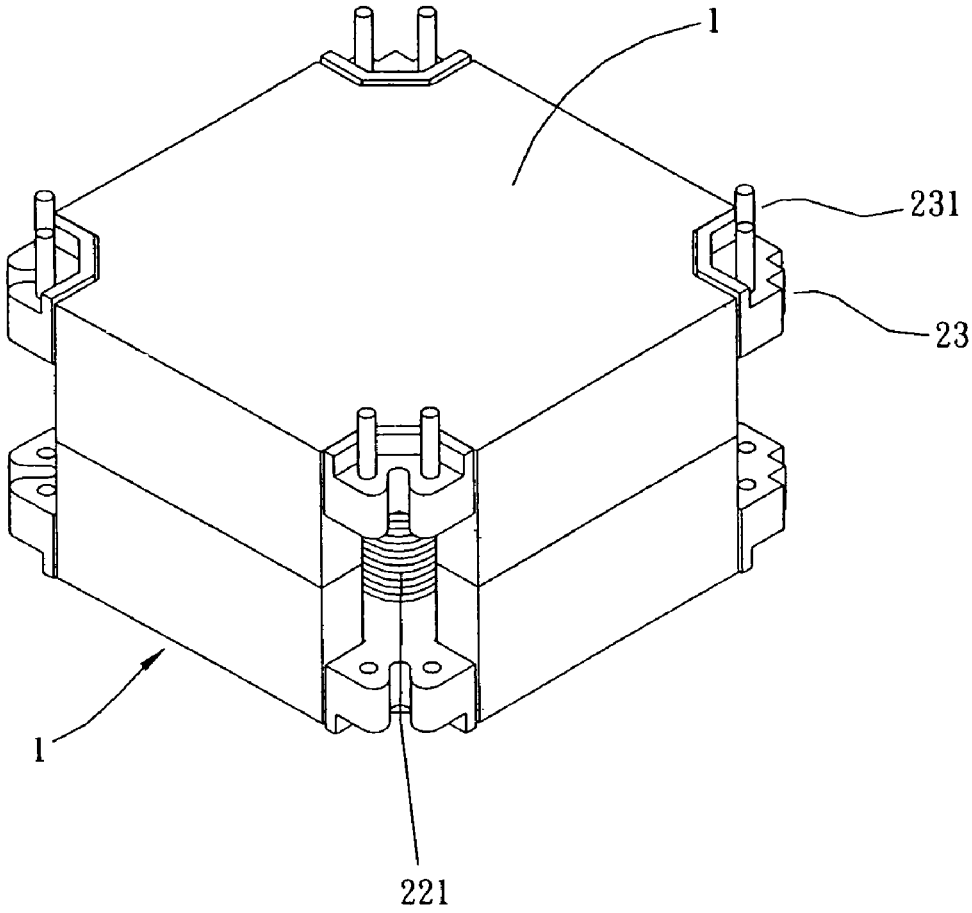
FIG. 5 is an isometric view of the invention after being assembled.

FIG. 5 is an isometric view of the invention after being assembled. As shown in FIG. 5, when it comes to assembling, by the use of their center posts (11), the two cores (1) insert in opposite manner into the center hole (21) of the wire frame (2). In the meantime, the two cores (1) make use of the two containing circumferential channels (12) to contain the wire frame (2) and make each of the lead-out seat (23) stretch out through each of the opening (131). In this way, the core (1), by the use of the circumferential side wall (13) forms an circumferentially surrounded integral covering at the periphery of the coil (221) of the wire frame (2) leaving only a small area of exposure at each of the opening (131). Therefore, as compare with the conventional relevant structure, the magnetic leakage and efficiency of the inductance or the transformer of the invention have prominent improvement.

It will become apparent to those people skilled in the art that various modifications and variations can be made to the structure of the invention without departing from the scope or spirit of the invention. In view of the foregoing description, it is intended that all the modifications and variation fall within the scope of the following appended claims and their equivalents.

What is claimed is:

1. An improved structure of inductance core and wire frame comprising two portions: a core and a wire frame; a center post equipping at the center portion of the core has a containing circumferential channel providing at the periphery thereof; a center hole providing at the center portion of the wire frame has a bobbin providing at the periphery thereof for the winding of a coil; by the use of the center posts, the two cores insert in opposite manner into the center hole of the wire frame; the improved structure is characterized by that:

a circumferential side wall is provided at the periphery of the containing circumferential channel of the core, and an opening is provided at each corner of the containing circumferential channel; in addition, a salient lead-out seat is provided at each corner of the wire frame stretching out through each of the opening and making the circumferential side wall form an circumferentially surrounded integral covering at the periphery of the coil of the wire frame.

2. The improved structure of inductance core and wire frame as claimed in claim 1, wherein a brazing post is provided at each of the lead-out seat to connect respectively to the drawing head drawn from a coil.

* * * * *